United States Patent [19]

Yohe

[11] Patent Number: 4,548,786

[45] **Date of Patent: * Oct. 22, 1985**

[54] COATED CARBIDE CUTTING TOOL INSERT

[75] Inventor: Warren C. Yohe, Mt. Clemens, Mich.

[73] Assignee: General Electric Company, Detroit, Mich.

[ * ] Notice: The portion of the term of this patent subsequent to Feb. 5, 2002 has been disclaimed.

[21] Appl. No.: 489,286

[22] Filed: Apr. 28, 1983

[51] Int. Cl.[4] ..... B22F 3/12; C22C 29/00

[52] U.S. Cl. ..... 419/29; 419/57; 419/58; 75/244; 75/246; 75/235

[58] Field of Search ..... 419/57, 58, 13, 14; 75/244, 246, 238, 235

[56] References Cited

U.S. PATENT DOCUMENTS

| | | | |
|---|---|---|---|
| 2,036,245 | 4/1936 | Walter | 75/238 |
| 2,612,442 | 9/1952 | Goetzel | 428/555 |
| 3,147,542 | 9/1964 | Boeckleler | 428/457 |
| 3,971,656 | 7/1976 | Rudy | 419/57 |
| 4,049,876 | 9/1977 | Yamamoto et al. | 428/565 |
| 4,063,938 | 12/1977 | Weissman | 75/205 |
| 4,150,195 | 4/1979 | Tobioka et al. | 428/548 |
| 4,277,283 | 7/1981 | Tobioka et al. | 75/238 |
| 4,282,289 | 8/1981 | Kullander et al. | 428/457 |

FOREIGN PATENT DOCUMENTS

| | | |
|---|---|---|
| 48-32734 | 5/1973 | Japan . |
| 168109 | 2/1982 | Japan . |
| 2095702 | 10/1982 | United Kingdom . |

OTHER PUBLICATIONS

Suzuki et al., Transactions of the Japan Institute of Metals, vol. 22, No. 11, (1981) pp. 758–764 (English).

Suzuki et al., Nippon Kinzoku Gakkai-shi, vol. 45, No. 1, pp. 95–99, 1981 Translation.

Hayashi et al., J. of Japan Society of Powder and Powder Metallurgy, vol. 29, No. 5, Jul. 1982, pp. 159–163 (English Abstract only).

Suzuki et al., Japan Society of Powder and Powder Metallurgy, vol. 29, No. 2, Feb. 1982, pp. 54–57—(English Abstract only).

Suzuki et al., Japan Society of Powder and Powder Metallurgy, vol. 29, No. 1, Jan. 1982, pp. 25–29 (English Abstract only).

*Primary Examiner*—Edward A. Miller

*Assistant Examiner*—Anne Brookes

*Attorney, Agent, or Firm*—A. E. Bahr; E. F. Chapman; J. J. Lichiello

[57] ABSTRACT

Cobalt cemented carbide cutting inserts are prepared for coating with a hard, wear-resistant coating by providing a cobalt enriched zone on a surface to be coated. Cobalt enrichment is effectuated by means of nitrogen gas contact with the carbide followed by a period of vacuum sintering during its sintering process of manufacture.

6 Claims, 4 Drawing Figures

COATED CARBIDE CUTTING TOOL INSERT

CROSS-REFERENCE TO RELATED APPLICATION

This patent application relates to U.S. patent application Ser. No. 489,287 filed Apr. 28, 1983, now U.S. Pat. No. 4,497,874, in the name of Thomas E. Hale for "Improved Coated Carbide Cutting Tool Insert", and is assigned to the assignee of the above-identified patent application.

BACKGROUND OF THE INVENTION

This invention relates to an improved coated carbide cutting tool insert, and more particularly to a cobalt enriched zone in a cobalt cemented carbide insert substrate which supports a multiple layered coating, at least one of which layers is a thicker, hard wear-resistant carbide material.

FIELD OF THE INVENTION

Coated cemented carbide inserts have been effectively utilized in many metal working operations for a number of years. Basically, they are composite materials prepared by chemical vapor depositing (CVD) processes which provide a thin layer of a hard wear resistant coating, for example, titanium carbide (TiC), on a hard metal substrate surface such as a cemented carbide (WC). In some instances, the TiC layer is preceded by an underlayer, titanium nitride (TiN) for example, and an overlayer of TiN, aluminum oxide ($Al_2O_3$) and the like. Multilayer inserts have found application in a broad range of metal cutting applications, and various layers and their materials may be selected to suit the metal removal application.

DESCRIPTION OF THE PRIOR ART

The manufacture of coated cemented carbide tools and inserts includes a number of chemical and physical requirements. The coating layers utilized must be chemically stable and physically wear resistant in various metal cutting and wearing operations. The composition and thickness of these coatings are quite relevant because they must not easily spall or crack. More importantly, however, they must be integrally supported by and securely bonded to the insert substrate. Titanium carbide layers, titanium nitride layers, titanium carbonitride layers, TiCN, and aluminum oxide layers, $Al_2O_3$, in numerous combinations, structures, and ordered layers are known in the art. However, titanium carbide, TiC, has emerged as the predominant wear surface and, accordingly, titanium carbide layers have been laid down on various substrates by a number of different processes to perform as a hard wear surface.

When there are two or more dissimilar layers, the supporting relationship between the multiple layers and a cemented carbide substrate is most important from a structural point of view, and since TiC is the important layer its relationship and bond to the cemented carbide substrate are critical. For this reason the TiC layer is usually next adjacent the substrate and some advantage is taken of the affinity of the two carbides for an integrating structural support. Because of the noted superiority of TiC layers as the predominant, hard wear-resistant layer, some attention has been given to ways and means to use thicker TiC layers and also additional individual layers of other materials which contribute to the effectiveness of the TiC layer. The result of thicker layers generally is a weakening of the structure.

With respect to adequately supporting the hard wear resistant outer layers on cemented carbide substrates, and effectively supporting more and thicker layers, recent improvements include a metallurgical gradation of the layers at their junctures which define transitional zones incorporating elements from each adjacent layer. In the case of a cobalt cemented carbide substrate, this gradation relates to a surface zone or region of the substrate which is enriched in cobalt in that it contains a higher average concentration of cobalt than found elsewhere in the cemented carbide. This cobalt enriched zone is used to provide improved toughness to the cutting edge of a coating thereon and an improved surface on which to deposit a coating such as TiN and TiC. However, the processes used to accomplish this enrichment are complex, relatively expensive, separate from the carbide manufacturing process and not precise in locating the cobalt where it is most desired.

SUMMARY OF THE INVENTION

The present invention discloses an improved process of providing a cobalt gradation zone in a cobalt cemented carbide which is combined with a carbide manufacturing process. The cobalt zone more effectively supports thicker multilayer coatings of hard, wear-resistant materials, including coatings where TiC is not the first layer.

THE DRAWINGS

This invention will be better understood when taken in connection with the following description and the drawings in which.

DESCRIPTION OF THE INVENTION

Figure 1:
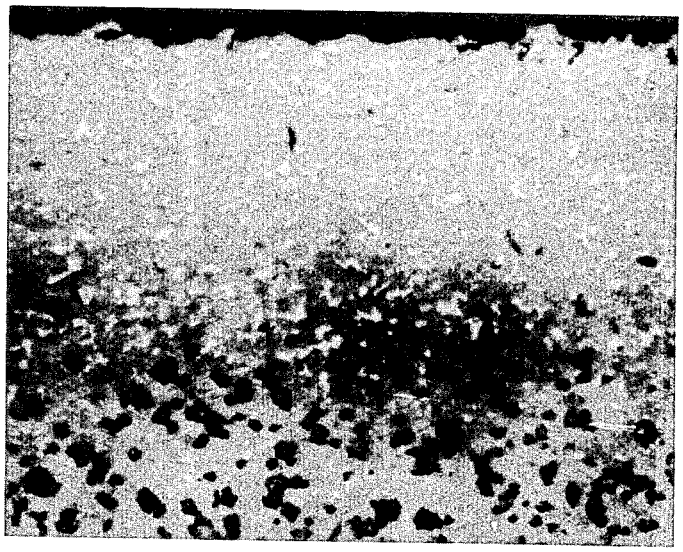
FIG. 1 is a photomicrograph of one insert embodiment of this invention indicating cobalt enrichment.

In one preferred form of this invention, gaseous nitrogen is controllably injected into the sintering cycle of a cemented carbide manufacturing process in order to provide different degrees of cobalt enrichment in the resulting cemented carbide substrate. By this means, an improved cobalt enrichment zone and an improved surface are provided for subsequent deposition of hard wear resistant layers.

There are three important interrelated contributing factors to an improved cutting tool, one example of which comprises (a) a cobalt-enriched cemented carbide substrate for strength purposes, (b) an outer surface with optimum cobalt dispersion and enrichment, and (c) a multilayer coating combination of hard material layers which may include, for example, TiN, TiC and TiN. The cemented carbide substrate of the present invention may include a number of cemented carbide substrates of different compositions but preferably is a cobalt cemented tungsten carbide substrate of the following general proportions: 2–5 wt. % of TiC, 5–10 wt. % TaC, 5–10 wt. % Co, balance WC. An article is prepared by the usual powder metallurgy process, milling the powders, pressing the powder into compact form, and sintering the compacted form at temperatures above the melting point of the cobalt phase.

The substrate of this invention incorporates a cobalt enriched zone at or adjacent to its outer surface. Some examples of prior cobalt enrichment are found in U.S. Pat. No. 2,612,442 Goetzel, and copending application Ser. No. 489,287, filed Apr. 28, 1983 by Hale, assigned to the same assignee as the present invention. As one example, a cobalt cemented carbide insert is subjected to elevated temperatures at above about the melting point of the cobalt in the substrate to cause the cobalt to progress, migrate or diffuse to a surface region or zone. The cobalt-enriched surface zone is an important concept in the structural integrity of multilayer coated inserts. The cobalt-enriched zone changes the hardness characteristics of the interface surface between the substrate and the adjacent coating and provides a tougher surface.

A cobalt enriched zone has been achieved by various processes in the cutting tool art, involving high-temperature diffusion, or higher temperature melting and migration of the cobalt to the surface. However, not all cobalt-enriched surfaces provide the same final result for a cutting tool insert. The kind of cobalt enrichment as well as the kind of next adjacent surface are quite important. For example, a coextensive cobalt layer at the extreme outer surface of the substrate where it would be in engagement with a coating layer is undesirable and either should not be formed, or should be subsequently removed before a coating layer is deposited. Further, for some applications the content of cobalt in the enriched zone should be at least about 2 times the average amount of cobalt in the substrate.

One process for providing a cobalt enriched zone involves the addition of various compounds into the original cemented carbide powder mixture prior to its pressing and sintering which react to form a surface layer of tungsten carbide (WC) and cobalt (Co), and an inner hard phase region containing a portion defined as a B-1 type, solid solution hard phase, usually having a face centered cubic structure of the carbides of IV-a to VI-a group transition metals in the Periodic Table, such as (Ti,W) (C,N), in addition to the WC and Co. See U.S. Pat. Nos. 4,150,195 Tobioka and 4,277,283 Tobioka. For example, Ti(CN) as a solid solution is substituted for the TiC in the cemented carbide formulation. When sintered in a vacuum such materials yield a surface zone depleted in the so called B-1 cubic phase, and consequently enriched in cobalt and WC. The mechanism is believed to be a decomposition of the B-1 solid solution phase containing Ti(CN) in vacuum to form titanium which is soluble in the liquid cobalt and is transported to the interior of the substrate.

In the improved process of the present invention, the insert is treated with a material containing nitrogen during its manufacturing sintering operation so that the (W, Ti) C which it contains is nitrided. Nitrogen gas is injected into the sintering furnace during the heating part of the sintering cycle, in particular during a holding period of from about 20 to about 180 minutes at a temperature of approximately 1200° to 1300° C. Higher temperature holds in nitrogen may be included subsequent to the initial 1200° C. to 1300° C. hold. The insert is subjected to vacuum conditions during this sintering process after nitrogen injection to promote diffusion of nitrogen out of the part, thus inducing a nitrogen gradient which sets up the cobalt enriched zone. In certain preferred embodiments, subsequent heating is carried out under vacuum at an elevated temperature below or about the sintering temperature. Varying the conditions of nitrogen pressure, hold temperature, and hold time will affect the depth of the resulting B-1 phase depletion as well as the degree and depth of the cobalt enrichment. Zones up to 40 microns deep and cobalt enrichment to a level of about 15% (in a 6% nominal Co composition) have been produced. Following are specific examples of the processes of this invention.

EXAMPLE I

Figure 2:
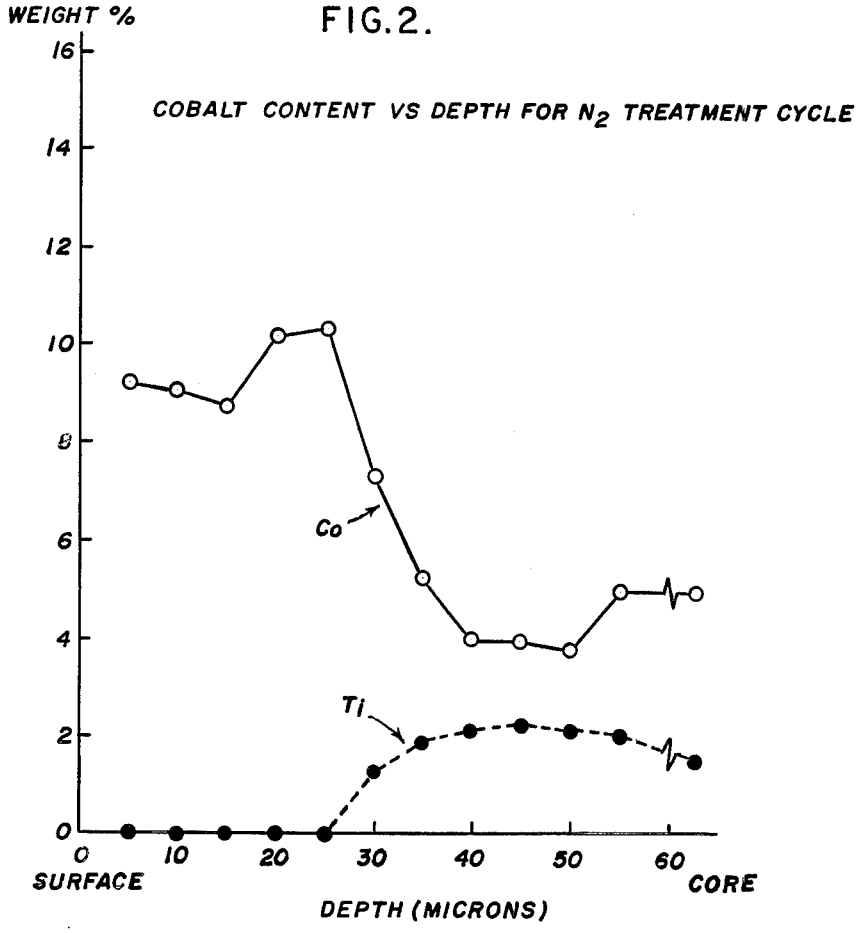
FIG. 2 is a graph indicating cobalt distribution in the enriched zone of FIG. 1.

A pressed powder composite or insert composed of 83.0% WC, 6% TaC, 6% Co, and 5.0% ($W_{0.5}Ti_{0.5}$) C by weight was placed in a vacuum-sintering furnace on a carbon-coated graphite shelf. The part was heated in the conventional manner to remove wax and then heated to 1260° C. While it was being held at 1260° C., nitrogen gas was introduced at the rate of 3 liters/minute to a pressure of 600 Torr. After 45 minutes of this treatment, the nitrogen was evacuated and the furnace temperature was raised to 1445° C. for 100 minutes for sintering. Argon at a pressure of 2 Torr was injected to moderate cobalt loss while still allowing nitrogen diffusion out of the insert. The inserts were then allowed to cool at the natural cooling rate (20–30 degrees/ minute). The micrograph of FIG. 1 of the resulting surface region shows a 30-micron deep B-1 phase depleted layer with an increased cobalt concentration. FIG. 2 shows a plot of cobalt and titanium content versus depth below the surface as measured in a scanning electron microscope with energy-dispersive X-ray analysis. The cobalt is enriched to a peak level of 10% in the region where the titanium (B-1 phase) is depleted.

EXAMPLE II

A pressed powder composite or insert of the same composition as Example I was placed in a vacuum-sintering furnace on a graphite shelf. The part was heated in the conventional manner to remove wax. After dewaxing, nitrogen gas was introduced at 450° C. at the rate of 3 liters/minute to a pressure of 20 Torr. The temperature was raised to 1260° C., held 45 minutes, and then raised to 1480° C. for 45 minutes. The nitrogen gas was then evacuated and then backfilled with argon to a pressure of 2 Torr. The temperature was dropped to 1445° C. and held 45 minutes. The inserts were then allowed to cool at the natural cooling rate (20–30 degrees/minute). The resulting surface structure showed a 25-micron deep B-1 phase depleted layer with an increased cobalt concentration having a peak level of 14.7%.

EXAMPLE III

Figure 3:
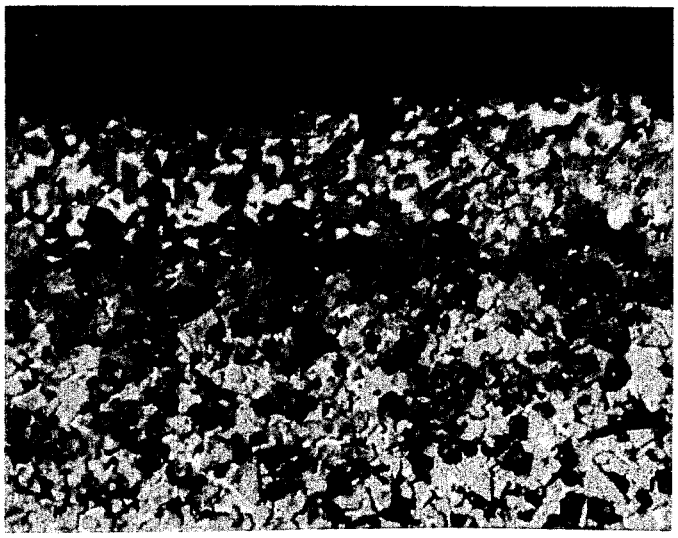
FIG. 3 is a photomicrograph of an insert of Example III.
Figure 4:
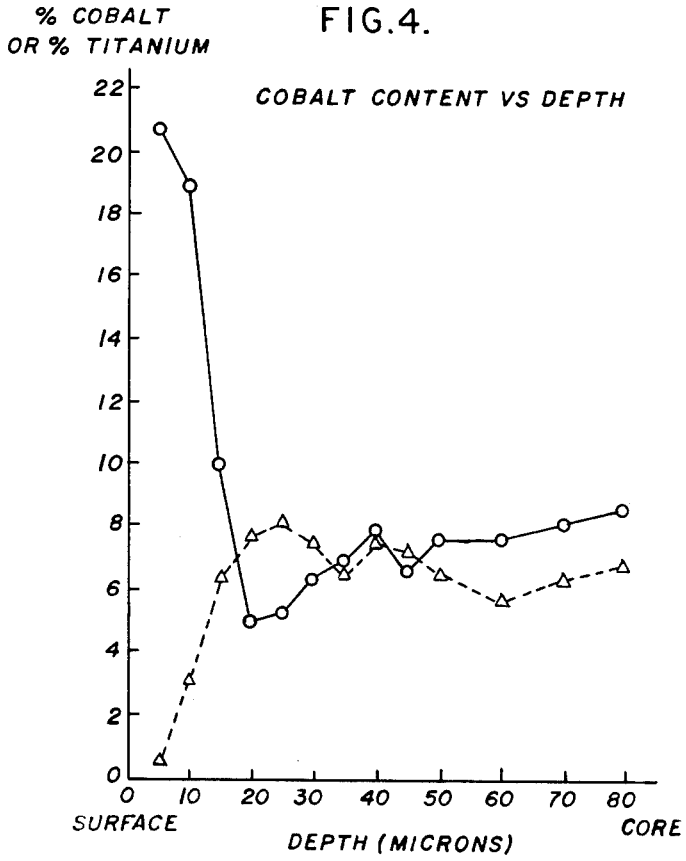
FIG. 4 is a graph indicating cobalt distribution in the insert of Example III.

A pressed powder composite or insert composed of 64% WC, 16.0% $W_{0.5}Ti_{0.5}C$, 11.5% TaC, and 8.5% Co was placed in a vacuum-sintering furnace on a carbon-coated graphite shelf. The part was heated in the conventional manner to remove wax. Nitrogen was introduced to a pressure of 600 Torr at 450° C. after the wax was removed, and then the part was heated to 1260° C. and held at this temperature for 45 minutes. The temperature was then raised to 1480° C. and held for 45 minutes. The nitrogen was evacuated and the temperature was reduced to 1445° C. At this temperature, argon was introduced to a pressure of 2 Torr to moderate cobalt loss, and the temperature was held for 45 minutes. The inserts were then allowed to cool at the natural cooling rate. As seen in FIG. 3, the resulting surface region showed a 15-micron deep B-1 phase depleted cobalt-enriched zone. The plot of cobalt and titanium content in FIG. 4 shows a peak enrichment to a level of 21.8% cobalt at the surface.

The temperature range of nitrogen injection has been varied from 1200° C. to 1480° C., but the total range may extend somewhat higher and lower. It is preferable to initially introduce nitrogen below the liquidus temperature (about 1300° C.) to allow the infiltration of nitrogen gas before the closing off of porosity during the early stages of sintering. Injecting nitrogen only at sintering temperatures has been shown to provide shallower zones. Longer hold times would be rquired for equivalent nitriding. This may be necessary for treating previously sintered and ground inserts. Increasing the second nitrogen hold temperature increases the zone depth and cobalt enrichment when nitrogen is initially introduced below 1300° C. Nitrogen pressures have been utilized from about 6 Torr to about 600 Torr. The nitrogen treatment "hold" time had little effect on the zone depth, but increased time, up to 90 minutes, improved the cobalt enrichment. On the other hand, the length of sintering hold time more than 45 minutes had little effect on cobalt enrichment, but increasing time increased the zone depth. The carbon content of the composition has an effect on zone depth and cobalt enrichment reaching a maximum with increasing amounts of carbon, and then falling off. Too much carbon (when present in levels that produce nodular carbon instead of flake carbon) may inhibit zone formation altogether.

One advantage of this invention is that the enriched zone is produced in the sintering process alone, with separate control over the B-1 phase depletion depth and cobalt enrichment. Also, the nitrogen treatment method can avoid the formation of a pure cobalt surface layer which interferes with adhesion of subsequently deposited coatings. In this invention there is no pool of cobalt on the outer surface or large areas of essentially cobalt. The cobalt distribution, as shown in the photomicrograph of FIG. 1, is essentially the same at and just below the outer surface. The surfacce is as mooth and uniform as that prepared by conventional sintering techniques and fits well with current sintering practice.

The use of a cobalt-enriched substrate facilitates the use of certain multilayer coatings. These multilayer coated inserts include a substrate having one or more TiN, TiC, and TiN or $Al_2O_3$, layered coatings thereon in various combinations or gradations. One specific improved insert is the cobalt enriched substrate of this invention coated in series with TiN, TiC, and a final TiN layer on a layer of aluminum oxide, $Al_2O_3$. In such combination the most essential layer is the TiC layer. It is the TiC layer which is the layer which does most of the work involved. It is the hardest wear-resistant layer and has been known to be the essential layer in the cutting tool insert art. It follows, therefore, that it is desirable for the TiC layer to be as thick as possible, commensurate with the structural integrity of the substrate. In this invention, a structural improvement is first achieved by the cobalt-enriched zone. The cobalt enriched zone of an insert produced by this invention may be gainfully employed to support various multilayer coatings. One example is the coatings disclosed in the above copending application, Ser. No. 489,287, filed Apr. 28, 1983 by Hale, now U.S. Pat. No. 4,497,874. In the Hale application a first layer of TiN is vapor-deposited on the cobalt-enriched surface for an improved correlation with the enriched zone and a subsequent layer of TiC. Because of the structural and bonding integrity of the TiN/cobalt zone relationship, a much thicker TiC working layer can be employed.

Although the present invention has been described with reference to the foregoing specification, many modifications, combinations and variations of the invention wil be apparent to those skilled in the art in light of the above teachings. The practice of the invention is amenable for use with other carbide materials and other binder materials, iron and nickel as examples of other binders. It is therefore understood that changes may be made to the particular embodiments of the invention, which are within the full intended scope of the invention as defined by the following claims.

I claim:

1. A process for providing a cobalt cemented carbide article with a cobalt-enriched zone comprising, in sequence;

(a) heating a compressed composite mixture consisting essentially of tungsten carbide, cobalt and B-1 solid solution phase forming, carbide constituents in a furnace to provide a composite heated below the sintering temperature;

(b) contacting said composite heated at a temperature in the range of 1200° C. to 1500° C. with nitrogen gas to nitride the B-1 phase; and (c) subjecting the composite having the nitrided B-1 phase to vacuum while the composite is heated at an elevated temperature below or about the sintering temperature to produce a cobalt-enriched surface zone.

2. The process of claim 1 wherein said nitrogen gas is below atmospheric pressure.

3. The process as recited in claim 2 wherein said nitrogen is introduced over an extended period of time, and thereafter the temperature of the composite is raised or lowered to its sintering temperature above about 1400° C. in a vacuum.

4. The composite made by the process of claim 3 which thereafter is coated with a hard, wear-resistant material.

5. The composite of claim 4 wherein the hard, wear-resistant material is a layer of TiN.

6. The composite as recited in claim 5 wherein a layer of TiC is deposited on the layer of TiN and a layer of $Al_2O_3$ is deposited on the layer of TiC.

* * * * *